US012178327B2

(12) United States Patent
Maxfield et al.

(10) Patent No.: US 12,178,327 B2
(45) Date of Patent: Dec. 31, 2024

(54) HYBRID PAD

(71) Applicant: Argon Technologies, Inc., Kaysville, UT (US)

(72) Inventors: Matthew Maxfield, North Salt Lake, UT (US); Cory Tholl, Kaysville, UT (US); Tyler Westbroek, Clearfield, UT (US)

(73) Assignee: Argon Technologies, Inc., Kaysville, UT (US)

( * ) Notice: Subject to any disclaimer, the term of this patent is extended or adjusted under 35 U.S.C. 154(b) by 203 days.

(21) Appl. No.: 17/127,780

(22) Filed: Dec. 18, 2020

(65) Prior Publication Data

US 2021/0186225 A1 Jun. 24, 2021

Related U.S. Application Data

(60) Provisional application No. 62/950,654, filed on Dec. 19, 2019.

(51) Int. Cl.

| | |
|---|---|
| ***A47C 27/08*** | (2006.01) |
| ***A47C 27/00*** | (2006.01) |
| ***A47C 27/10*** | (2006.01) |
| ***A47C 27/12*** | (2006.01) |
| ***A47C 27/14*** | (2006.01) |
| ***A47C 27/18*** | (2006.01) |

(52) U.S. Cl.

CPC ..... *A47C 27/087* (2013.01); *A47C 27/082* (2013.01); *A47C 27/128* (2013.01); *A47C 27/146* (2013.01); *A47C 27/18* (2013.01); *A47C 27/001* (2013.01); *A47C 27/08* (2013.01); *A47C 27/10* (2013.01)

(58) Field of Classification Search

CPC ... A47C 27/087; A47C 27/082; A47C 27/128; A47C 27/146; A47C 27/18; A47C 27/088; A47C 27/08; A47C 27/081; A47C 27/10; A47C 27/001

See application file for complete search history.

(56) References Cited

U.S. PATENT DOCUMENTS

| | | | | | |
|---|---|---|---|---|---|
| 195,850 | A | * | 10/1877 | Shepherd | A47C 27/001 5/723 |
| 410,133 | A | * | 8/1889 | Blocher | A47C 27/001 5/690 |
| 1,271,496 | A | * | 7/1918 | Wilson | A47C 27/001 5/722 |
| 1,312,110 | A | * | 8/1919 | Duncan et al. | A47C 19/022 5/633 |

(Continued)

*Primary Examiner* — Justin C Mikowski
*Assistant Examiner* — Morgan J McClure
(74) *Attorney, Agent, or Firm* — Dentons Durham Jones Pinegar; Sarah W. Matthews

(57) ABSTRACT

This disclosure relates to a padded sleeping system that includes an inflatable frame formed by a first sheet of material that is joined to a second sheet of material along a periphery and at a number of bond lines in order to form an inflatable support member. The padded sleeping system may also include at least one valve that is fixed to the inflatable frame, the valve being in fluid connection with the inflatable support member for inflation and deflation of the inflatable frame. The system may also include a cushion portion, which may be fixed to the inflatable frame. The cushion portion may provide support and additional comfort for a user.

20 Claims, 11 Drawing Sheets

(56) References Cited

U.S. PATENT DOCUMENTS 1,785,252 A * 12/1930 Frank ..... A47C 27/001 5/722
1,885,974 A * 11/1932 Winn ..... A47C 27/001 5/723
2,528,768 A * 11/1950 Marsh ..... A47C 27/001 297/109
4,213,214 A * 7/1980 Gilhooly ..... A47C 27/001 5/679
4,428,087 A * 1/1984 Horn ..... A47C 27/088 5/709
4,449,261 A * 5/1984 Magnusson ..... A47C 27/066 5/722
5,115,526 A * 5/1992 Boyd ..... A47C 27/085 5/680
5,136,741 A * 8/1992 Balonick ..... A47C 27/20 5/699
5,182,825 A * 2/1993 Stinson ..... A47C 27/085 5/678
5,329,656 A * 7/1994 Leggett ..... A47C 27/18 5/709
5,655,239 A * 8/1997 Caparon ..... A61G 7/05792 5/713
5,657,500 A * 8/1997 Messina ..... A47C 27/001 5/722
5,867,849 A * 2/1999 Pontrello ..... A47C 27/15 5/2.1
5,974,608 A * 11/1999 Haller ..... A47C 27/084 5/709
6,016,582 A * 1/2000 Larson ..... A47C 27/083 5/709
6,047,425 A * 4/2000 Khazaal ..... A47G 9/1027 5/640
6,055,689 A * 5/2000 Cavazos ..... A47C 31/105 5/655.8
6,088,857 A * 7/2000 Ogle ..... A47C 27/002 5/722
6,101,653 A * 8/2000 England ..... A47C 31/105 5/737
6,192,538 B1 * 2/2001 Fogel ..... A61G 7/05715 5/727
6,273,810 B1 * 8/2001 Rhodes, Jr. ..... A47C 27/083 297/452.47
6,691,356 B1 * 2/2004 Coma ..... A47G 9/062 5/722
7,150,060 B1 * 12/2006 Wu ..... A47C 27/10 5/713
8,732,877 B2 * 5/2014 Ramp ..... A47C 20/027 5/636
11,291,308 B1 * 4/2022 Aramli ..... A47C 27/001
2003/0028971 A1 * 2/2003 Chaffee ..... A47C 15/006 5/710
2004/0021361 A1 * 2/2004 Park ..... A47C 7/021 297/452.41
2005/0039265 A1 * 2/2005 Gladney ..... A47C 31/02 5/722
2005/0097674 A1 * 5/2005 Mileti ..... A61G 7/05776 5/710
2007/0094808 A1 * 5/2007 Jansen ..... A47C 27/001 5/738
2008/0000029 A1 * 1/2008 Feingold ..... A47C 27/18 5/690
2011/0004999 A1 * 1/2011 Hale ..... A47C 27/14 5/733
2012/0204350 A1 * 8/2012 Katsnelson ..... A47G 9/1027 156/308.2
2012/0248845 A1 * 10/2012 Berryhill ..... A47C 27/001 297/452.58
2013/0269114 A1 * 10/2013 Wu ..... A47C 31/123 5/723
2014/0096325 A1 * 4/2014 Giannopoulos ..... A47C 27/00 5/691
2015/0007393 A1 * 1/2015 Palashewski ..... A47C 27/082 5/713
2015/0026895 A1 * 1/2015 Geelen ..... A47C 27/088 5/699
2015/0089747 A1 * 4/2015 Ni ..... A47C 27/15 427/244
2015/0289670 A1 * 10/2015 Mojtabavi ..... A47C 27/146 5/730
2015/0351564 A1 * 12/2015 Vogel ..... A47G 9/1054 5/640
2016/0128489 A1 * 5/2016 Lesley ..... A47C 27/001 5/722
2017/0020769 A1 * 1/2017 Bhat ..... A47C 27/18
2017/0119168 A1 * 5/2017 Al-Hazeem ..... A47C 27/001
2017/0173856 A1 * 6/2017 Park ..... B29C 66/1122
2017/0238717 A1 * 8/2017 Jensen ..... A47C 27/001
2018/0000256 A1 * 1/2018 Saunders, Sr. ..... A47C 21/00
2018/0168362 A1 * 6/2018 Dorfman ..... A47C 27/124
2018/0325761 A1 * 11/2018 Shih ..... A47C 27/10
2019/0099018 A1 * 4/2019 Holt ..... A47C 27/001
2019/0116987 A1 * 4/2019 Clousing ..... A47C 27/15
2019/0298078 A1 * 10/2019 Vester, III ..... A47C 27/001
2019/0307259 A1 * 10/2019 Keesaer ..... A61G 7/05776
2019/0320828 A1 * 10/2019 Berney ..... A47G 9/0253
2020/0093294 A1 * 3/2020 Ban ..... A47G 9/10
2020/0221884 A1 * 7/2020 Ambuske ..... A47C 27/15
2020/0239114 A1 * 7/2020 de Grasse ..... A47C 1/146
2020/0323355 A1 * 10/2020 Jacot ..... B32B 27/12
2021/0307520 A1 * 10/2021 Batey ..... A47C 20/027

* cited by examiner

HYBRID PAD

PRIORITY CLAIM

This application claims priority under 35 U.S.C. § 120 to U.S. provisional application 62/950,654, filed Dec. 19, 2019 ("the '654 application"). The '654 application is incorporated herein in its entirety.

TECHNICAL FIELD

This disclosure relates generally to various embodiments of a camping pad that may be a layered camping pad or hybrid camping pad, or hybrid pad. More specifically it relates to a camping mattress or pad that may comprise an inflatable frame that may incorporate a cushion-like layer, such as a sheet of foam, for additional support and comfort. The features disclosed herein are numerous in nature and may be employed in various different ways to provide the same or similar results.

BACKGROUND

When camping, a lightweight pad or mattress is typically used under a sleeping bag. Camping pads may provide support padding, and even some insulation for the user. Camping pads have typically fallen into two general categories: inflatable and not inflatable.

Camping pads that are not inflatable are essentially closed-cell strips of foam of a predetermined size. Such pads tend to be heavier than inflatable types. They may be used in any camping situation.

With respect to inflatable camping pads, there are two basic types of pads, both of which rely on a quantity of air for inflation during use and which deflate for portage.

A first, and generally older type of inflatable camping pad, is essentially an inflatable air mattress. A fill valve is opened and air is forced in under positive pressure by mouth, typically, to inflate the camping pad a desired amount.

A second, and generally newer type of camping pad, is a variation of the prior type. The second type may include an open-cell expandable type of foam filler within the open-cell. When a fill valve for such a type of camping pad is opened, the compressed foam (from the deflated state) within the open-cell of the camping pad begins to expand and naturally inflates the mattress. The camping pads that include the foam within the open-cell of the camping pads are generally regarded as being of superior design because they self-inflate (to a certain extent) and are therefore easier to use. They also tend to be warmer and therefore, more comfortable.

While these and perhaps other types of camping pads or mattresses have been used for a long time, they have certain disadvantages when used for camping. For example, virtually all campers are aware of the rarity of level, smooth ground. In addition, the ground tends to act as a heat sink that can rob the sleeper of valuable body heat, which can cause campers to be cold while sleeping on the ground.

SUMMARY

This disclosure relates to a padded sleeping system that comprises: an inflatable frame comprising a first sheet of material joined to a second sheet of material at a plurality of bond lines to form an air inflatable support member. The padded sleeping system may further comprise at least one valve that is coupled to the inflatable frame, which is in fluid connection with the air inflatable support member for inflation and deflation of the inflatable frame. The system may also comprise a cushion portion that may be fixed to the inflatable frame.

The air inflatable support member may further comprise multiple fluidly connected air inflatable support members, which may be defined by additional bond lines between the first sheet of material and the second sheet of material. These air inflatable support members may form linear cells that vary in size and shape based on their position relative to the cushion portion of the sleeping pad. Each of the air inflatable support members may alternatively form a cell or baffle that varies in size and shape based on its position with respect to where the user would place certain body parts when laying upon the padded sleeping system.

The cushion portion of the padded sleeping system may comprise a sheet of perforated open cell polyurethane foam having a width that conforms to a width of the inflatable frame and a length that is shorter than a length of the inflatable frame. In such an embodiment, the cushion portion may be fixed to a portion of the inflatable frame.

In a different embodiments, the cushion portion may comprise a plurality of cushion portions that vary in size and shape and are fixed to the inflatable frame at different positions.

In yet another embodiment, the cushion portion may comprise a plurality of individual cells filled with at least one of: foam, feathers, or cotton, or synthetic fiber. Additionally, the cushion material may include a mylar or heat reflective material, closed cell foam, synthetic fiber or any combination thereof.

DETAILED DESCRIPTION

Figure 1:
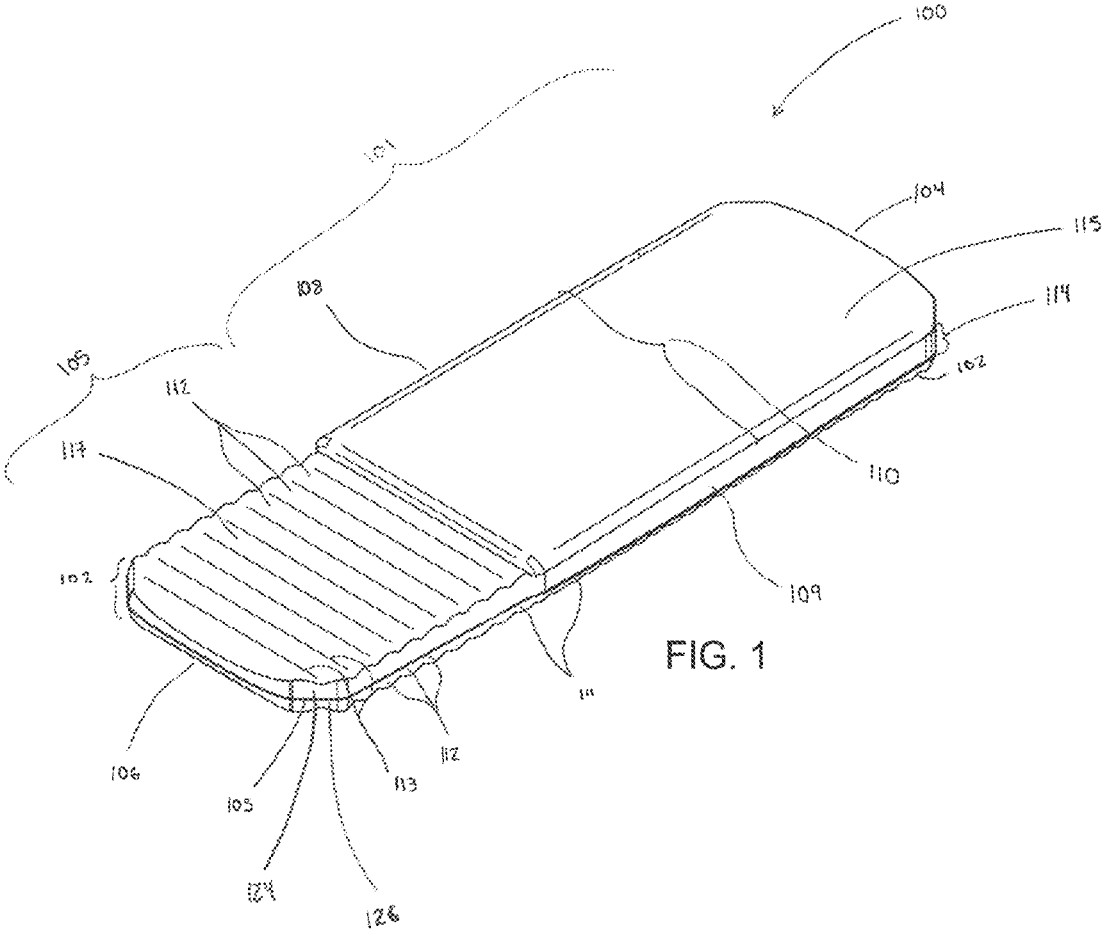
FIG. 1 is a top perspective view of a camping pad with an inflatable portion and a cushion portion.

FIGS. 1-5 illustrate an embodiment of a camping pad 100, or hybrid pad, or pad, which may be a layered camping pad. The camping pad may comprise an inflatable frame 102 having a length and width that defines a pad area, which may be suitable for supporting a person lying, or sitting thereon. The inflatable frame may extend between a first end 104 (i.e., head end) and a second end 106 (i.e., feet end) and a width that extends between a first side 108 and a second side 109. The camping pad 100 may also comprise a top portion 110 and a bottom portion 111, which may be substantially planar and parallel to each other.

Referring to FIG. 1, the inflatable frame 102 may be formed by joining a first sheet of material 124 to a second sheet of material 126 at a bond line 103, which may include an I-beam construction, around a perimeter of the first and second sheets of material in such a way that it forms a cell within the inflatable frame 102. The first sheet of material 124 may form a top side of the inflatable frame 102 and the second sheet of material 126 may form a bottom side of the inflatable frame 102. The I-beam may be formed by the first sheet of material 124 and the second sheet of material 126 with a tether between each bond line 103. Other potential constructions may be welding, ultrasonic welding, or the like, or any combination of these constructions methods which are further considered herein. The cell within the inflatable frame 102 may be inflated. The cell within the inflatable frame 102 may also comprise a plurality of fluidly coupled cells 112 or baffles, which may serve as inflatable support members. The pad 100 may further include a superior portion 101 toward the first end 104 and an inferior portion 105 toward the second end 106.

The plurality of fluidly coupled cells 112 may take various different forms, shapes and sizes. In FIG. 1, for instance, each cell of the fluidly coupled cells 112 may form a linear support member, which may extend between the first side 108 and the second side 109 of the camping pad 100. While the plurality of fluidly coupled cells 112 may be parallel to one another in FIG. 1, other configurations of fluidly coupled cells can be used. The plurality of fluidly coupled cells 112 may, for example, be arranged in such a way that the plurality of fluidly coupled cells 112 provides targeted support to particular parts of a person's body when lying thereon. In some configurations, the height of each of the fluidly coupled cells 112 or baffles may vary based on the what part of a user's body may be placed on that cell 112. Varying the height of the cells may help a user lay more flat on the camping pad 100 and additionally provided targeted support.

The plurality of fluidly coupled cells 112 may be formed in various different ways, by way of example, by incorporating various different patterns of bond lines 113 between the first sheet of material 124 and the second sheet of material 126. The bond lines 113 may be formed from welding the first sheet of material and second sheet of material to each other in a predetermined pattern. Alternatively, the bond lines 113 may be tethered from the first sheet of material 124 to the second sheet of material 126 through an I-beam weld wherein the bond lines 113 on each side of the first material and second material are not actually adjacent but are connected via an I-beam weld. In addition, the plurality of fluidly coupled cells 112 may also be formed as a result of the shape and contours of the first and second sheets of material that were joined together to create the inflatable frame 102.

Other embodiments of the inflatable frame 102 may further comprise various non-supporting regions, which may be defined by additional bond lines as set forth in U.S. Pat. No. 9,756,955.

The camping pad 100 may also comprise a cushion portion 114 positioned at the superior portion 101, which may provide additional comfort and support for users laying upon the camping pad 100. The cushion portion 114 may be made out of a variety of different padding materials, such as foam. More specifically, the cushion portion 114 may comprise a strip of perforated open cell polyurethane foam. The perforated nature of the foam may provide the camping pad 100 with greater flexibility, and it may also allow the camping pad to maintain a lighter weight. These features may allow for easier storage and portage. It may also improve the breathability of the camping pad 100, which may be useful when camping in warmer conditions. The cushion portion 114 may also comprise a cushion fabric sleeve 122 (see FIG. 6), which may be fixed around the cushion portion 114.

The cushion portion 114 may be separate from the inflatable frame 102. That is, the inflatable frame 102 and the cushion portion 114 may be attached, but not in fluid connection. In many prior art camping pads, the cushion is provided within the inflatable portion. A separation of the cushion portion 114 and the inflatable frame 102 may allow the padding or cushioning material to disperse better compared to cushioning material within an inflating portion. This may provide for additional support and comfort of a user.

The cushion portion 114 may take various different forms and be made of various different types of materials. For example, another embodiment of the cushion portion 114 may comprise a plurality of cells, which may be filled with a combination of at least one of the following: synthetic fibers, foam, soft feathers (e.g. down feathers), cotton, closed cell foam, heat reflective material or any combination thereof, or any other materials used in conjunction with mattresses or pillows. Depending on the material that the cushion portion 114 is made out of (such as unperforated foam or down feathers), the cushion portion 114 may provide a user with additional insulation, which may be useful when camping in colder conditions.

Figure 2A:
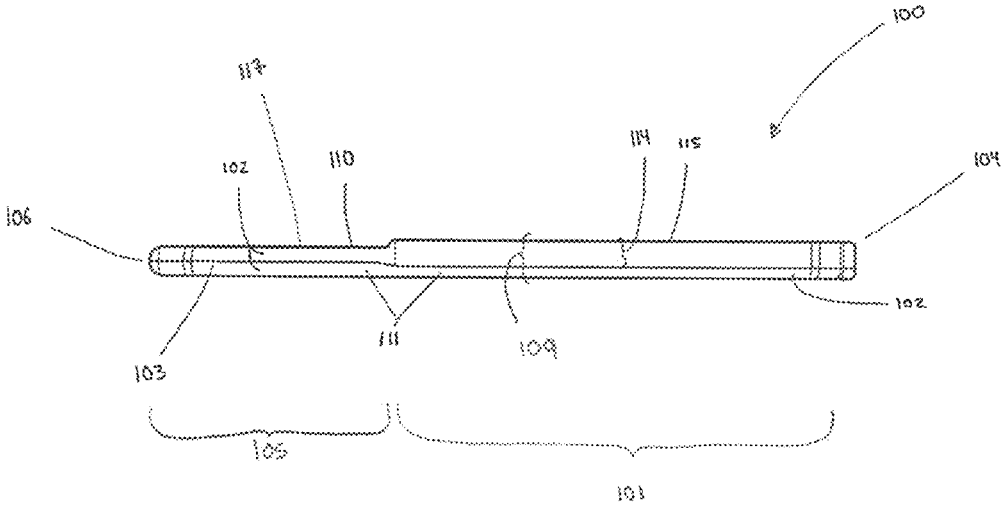
FIG. 2A is a longitudinal side view of the camping pad of FIG. 1.
Figure 2B:
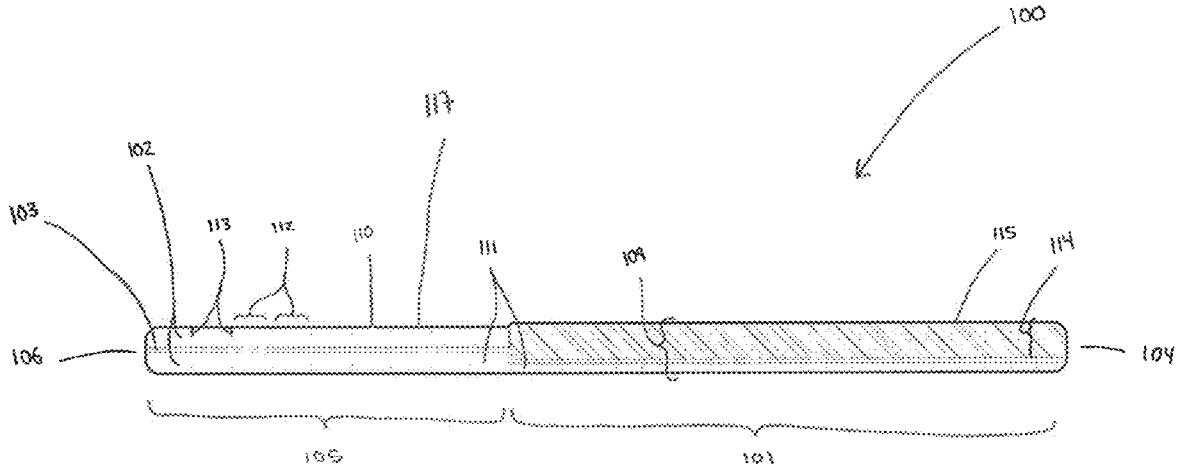
FIG. 2B is another longitudinal side view the camping pad of FIG. 1.
Figure 3:
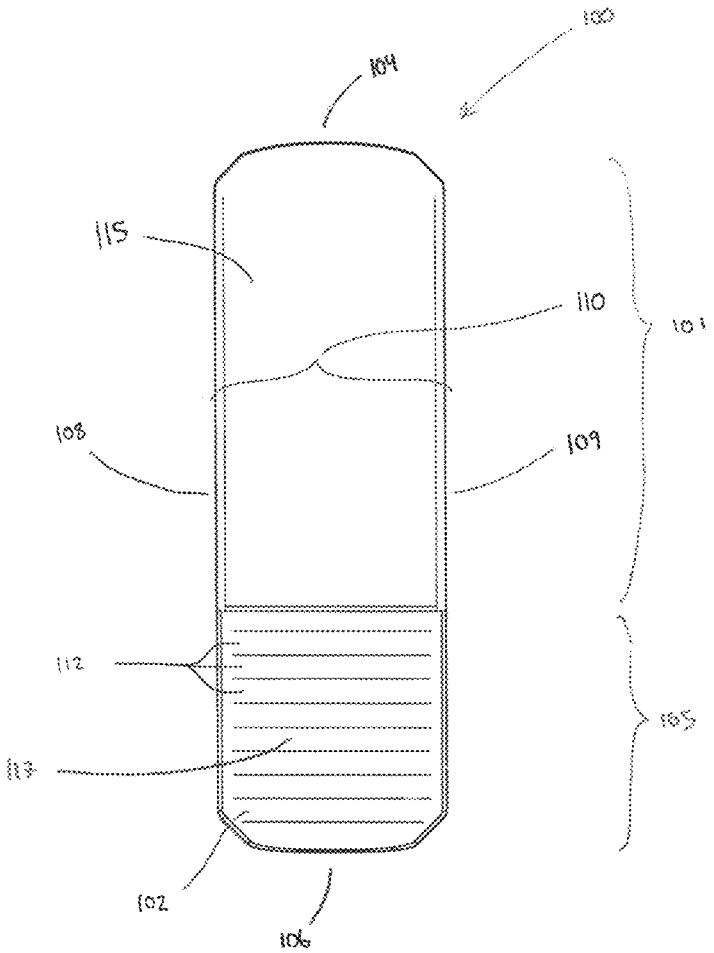
FIG. 3 is a top view of the camping pad of FIG. 1.

The cushion portion 114 may be incorporated into the camping pad 100 in various different ways. FIGS. 2A and 2B depict that while the bottom portion 111 of the inflatable frame 102 may extend the entire length between the first end 104 and the second end 106 of the camping pad 100, the cushion portion 114 may extend only partially the length of the camping pad 100. In some configurations, the top portion 110 of the camping pad 100 may be substantially planar even while transitioning from a cushion top portion 115 to an inflatable top portion 117. The inflatable top portion 117 may primarily extend toward the second end 106 as the inferior portion 105 of the pad 100. The cushion portion 114 may be coupled to the inflatable frame 102 in such a way that it, in effect, replaces part of the top portion 110 and becomes a separate layer of the camping pad 100. In other words, the cushion portion 114 may be coupled to the inflatable frame 102 where the top portion 110 would have been located if the inflatable top portion 117 would have extended the entire length of the camping pad 100. In this manner, the bottom portion 111 of the inflatable frame 102 and the cushion portion 114 may resemble separate layers which have been coupled together to form the hybrid camping pad 100.

In other configurations, the cushion portion 114 may not in effect replace part of the top portion 110, but rather may be added on top of the top portion 110. In such configurations, the superior portion 101 may have a taller height than the inferior portion 105 of the inflatable frame 102 such that the top of the cushion portion 114 of the superior portion 101 extends above a height of the inflatable frame 102 of the inferior portion 105. The inflatable top portion 117 and cushion top portion 115 may be substantially parallel plains.

The width of the cushion portion 114 may conform substantially to the width of the inflatable frame 102. The portion of the pad 100 with the cushion portion 114 may be thicker than any portion(s) of the pad 100 without the cushion portion 114. In some configurations, the pad 100 may have a uniform thickness because the cushion portion 114 extends the entire length or substantially the entire length between the first end 104 and the second end 106 of the camping pad 100. In other configurations, the thickness of the pad 100 may vary has some portions are provided with a cushion portion 114 and others are not.

The cushion portion 114 may be coupled to the inflatable frame 102 in various different ways, for example, by laser welding, ultrasonic welding, binding tape, an adhesive, by sewing the cushion fabric sleeve 122 (which may be fixed around the cushion portion 114) to the inflatable frame 102 or a combination of these or other means well known in the art. The cushion portion 114 may be attached to the exterior of the inflatable frame 102 such that it is separate from the inflatable frame to provide additional comfort and support to a user apart from the support provided by the inflatable frame 102. In some configurations, the cushion portion 114 may be directly coupled to the inflatable frame 102 and in other configurations a cushion fabric sleeve 122 (see FIG. 6) may be directly coupled to the inflatable frame 102, with the cushioning material 123 placed inside the cushion fabric sleeve 122.

In some configurations, the first sheet of material 124 forming the top of the inflatable frame 102 may be provided with an appendage 119 for a cushion fabric sleeve to be securely and aesthetically connected to the first sheet of material 124. For example, the appendage 119 may be a pleat or fold in the first sheet of material 124. This fold may be formed in any suitable manner. For example, the first sheet of material 124 may be doubled back on itself and secured in place by gluing, sewing, welding, etc. The appendage 119 need not be formed of the first sheet of material 124, and may also be formed by attaching a second piece of material to the first sheet of material 124, such as by gluing, sewing, welding, etc., the second piece of material to the first sheet of material 124.

The appendage 119 may be used to secure the cushion portion 114 to the exterior top side of the inflatable frame. For example, the cushion portion 114 may be comprised of a cushion fabric sleeve 122 with a cushioning material 123 placed within the cushion fabric sleeve 122. The cushion fabric sleeve 122 may be connected to the inflatable frame on one or more sides. For example, in some configurations the cushion fabric sleeve may be attached to the inflatable frame 102 on four sides, on the first side 108, the fold 119, the second side 109, and the first end 104. The appendage 119 may provide a secure place to attach one side of the cushion fabric sleeve, and may do so in an ascetically pleasing way. By providing a connecting point via the appendage 119, the cushion fabric sleeve 122 may be securely attached to the first sheet of material 124 over the appendage 119, covering all or substantially all of the appendage 119, without the need for an exterior connection or cover.

The cushion portion 114 may be incorporated into the camping pad 100 in various different ways. The cushion portion 114 may also form various different shapes and sizes, which may or may not conform to the shape and size of the inflatable frame 102. By way of example, on an alternative embodiment of the camping pad 100, the bottom portion 111 and the top portion 110 may both extend the entire length of the camping pad (from the first end 104 to the second end 106). In such an embodiment, the size and shape of the cushion portion 114 may not conform to the contours of the inflatable frame 102. The cushion portion 114 may be coupled to the camping pad 100 in such a way that it may be positioned to cover the entire top portion 110.

The cushion portion 114 may also alternatively comprise a plurality of cushion portions, which may be coupled to, or may replace, certain parts of the top portion 110. In such an embodiment, the plurality of cushion portions may be arranged in such a way that they may provide targeted support to specific parts of a user's body when lying thereon. By way of example, a cushion portion 114 may be positioned at the shoulders and/or hips of a user while the remainder of the pad 100 comprises only the inflatable portions.

Figure 4A:
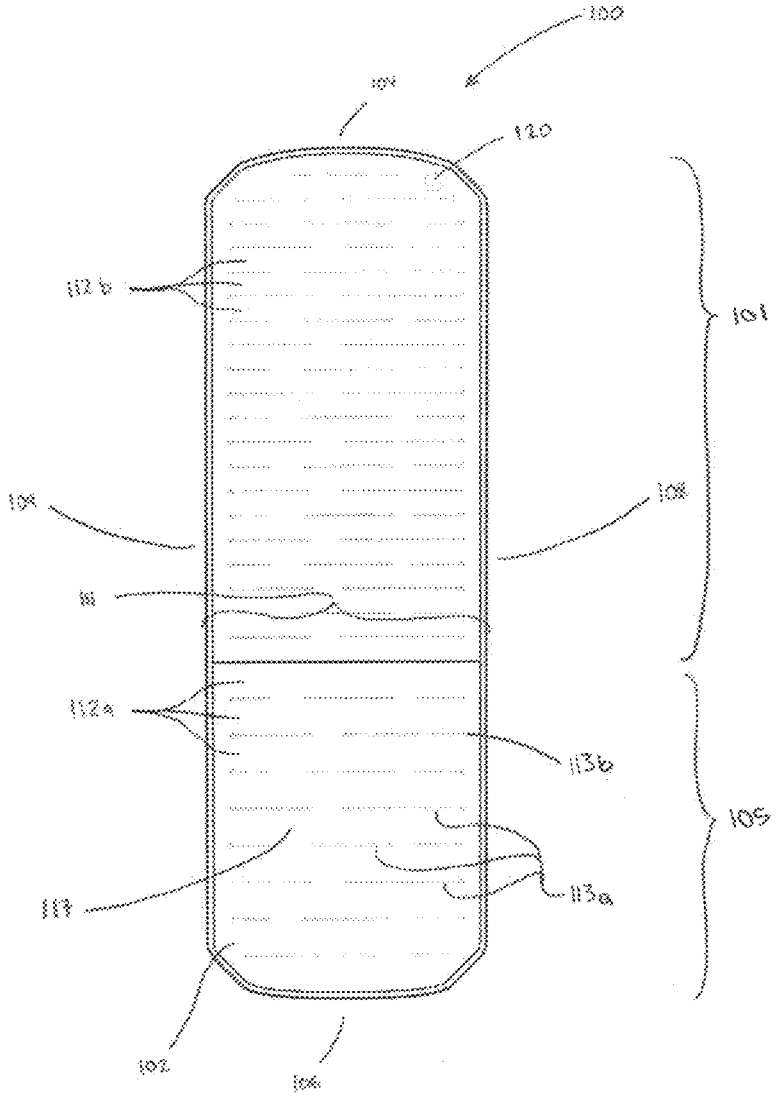
FIG. 4A is a bottom view of the camping pad of FIG. 1.

Referring to FIG. 4A, the camping pad 100 may also comprise a valve 120, that is able to inflate by any means necessary including a pump or by mouth. The position of the valve may be at any of a number of locations that allow for ease in inflation and deflation of the pad 100.

FIG. 4A also demonstrates that the bond lines 113 may form various different patterns, including for example staggered bond lines 113*a* that may run substantially parallel to the width of the inflatable frame 102. The staggered bond lines 113*a* may comprise a rounded end 113*b* at one or both ends of the bond lines. The rounded end 113*b* may be formed in various different ways, including for example by welding a greater surface area of the first sheet of material and a greater surface area of the second sheet of material to each other to form the rounded end 113*b*.

Many of the staggered bond lines 113*a* in FIG. 4A include the rounded end 113*b* on an end of the staggered bond lines 113*a* that are adjacent to the first side 108 or adjacent to the second side 109. Some of the staggered bond lines 113*a* in FIG. 4A that do not include an end that is adjacent to the first side 108 or the second side 109 do not include a rounded end 113*b* on either end. In alternative embodiments, the rounded end 113*b* may be included at any number of locations along the bond lines 113.

The bottom portion 111 of the camping pad 100 may be entirely an inflatable portion of the inflatable frame 102. The sizes and shapes of the fluidly coupled cells 112 may vary. The superior portion 101 may have fluidly coupled cells 112*b* that are situated directly adjacent to and beneath the cushion portion 114 of the camping pad 100 may have a narrower width. Fluidly coupled cells 112*a* of the inferior portion 105 that are not beneath the cushion 114 may have a wider width. The width of the fluidly coupled cells 112*a* of the inferior portion 105 may be wider in width than the fluidly coupled cells 112*b* of the superior portion 101. The fluidly coupled cells 112*b* of the superior portion 101 that are situated beneath the cushion portion 114 may provide the inflatable frame 102 with a more condensed volume of air providing stiffer structural support for the cushion 114. The fluidly coupled cells 112*b* of the superior portion 101 may also facilitate greater surface area for adhering the cushion portion 114 to the inflatable portion 102.

Figure 4B:
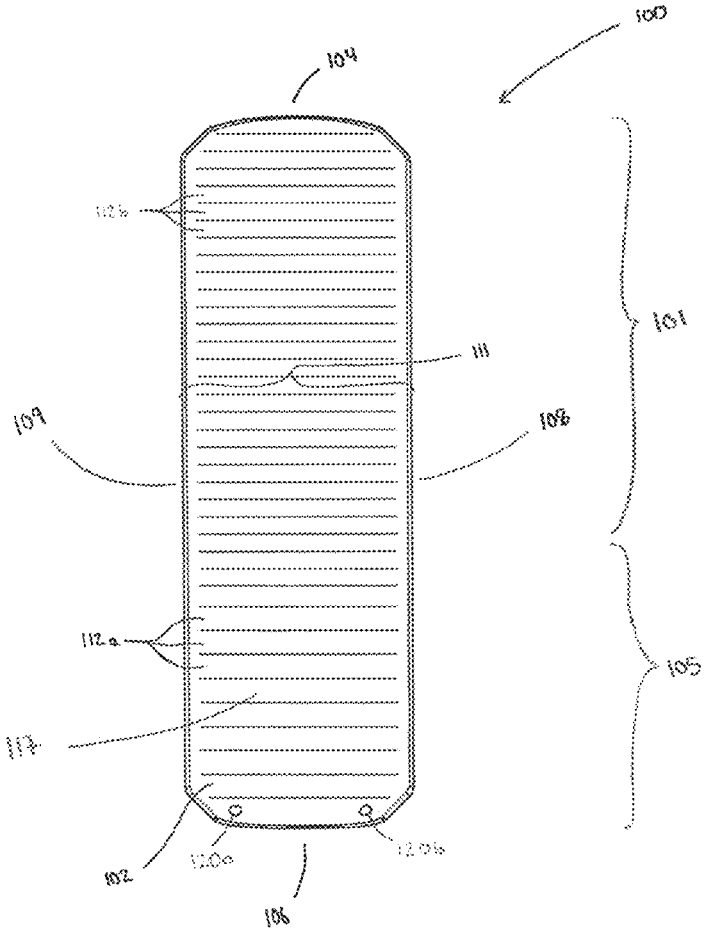
FIG. 4B is another bottom view of the camping pad of FIG. 1.

Referring to FIG. 4B, the camping pad 100 may alternatively comprise a first valve 120*a*, which a user may employ with his or her mouth to inflate the inflatable frame 102 and a second valve 120*b*, which may be connected to a pump for inflation. Both the first valve 120*a* and the second valve 120*b* may be in fluid communication with the inflatable frame 102 in such a way that allows the inflatable frame 102 to be inflated and deflated. Alternatively, the first valve 120*a* and second valve 120*b* may be a single valve.

Figure 5:
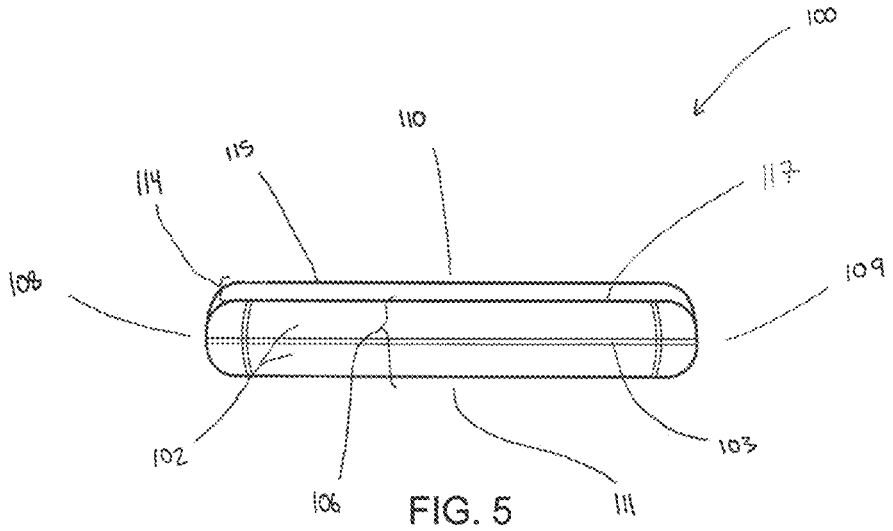
FIG. 5 is a transverse side view of the camping pad of FIG. 1.

Referring to FIG. 5, the dimensions of the cushion portion 114 of the camping pad 100 may not conform to the dimensions of the inflatable frame 102, the height of the superior portion 101, which includes the cushion portion 114, may be greater than the height of the inferior portion 105 of the inflatable frame 102.

Figure 6:
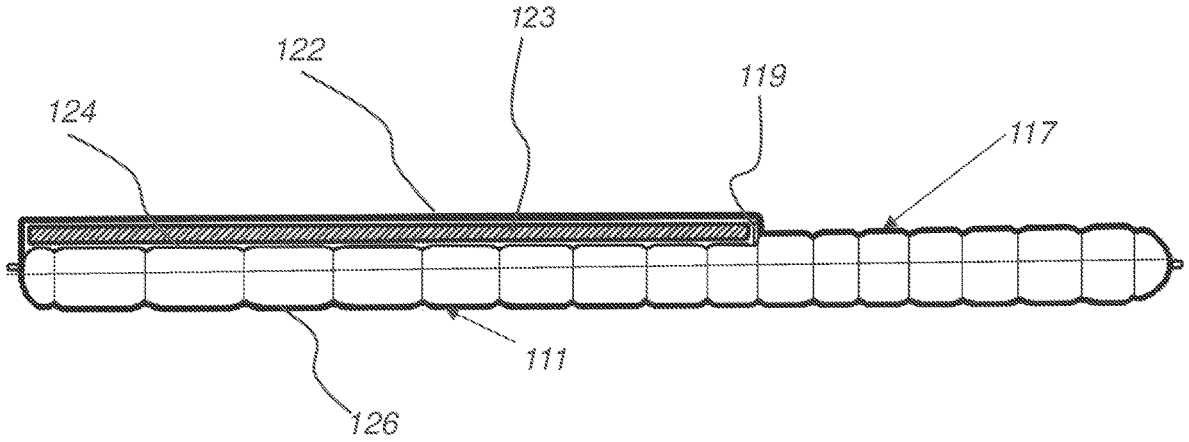
FIG. 6 is a side cut-away view of an exemplary camping pad according to the present disclosure.
Figure 7:
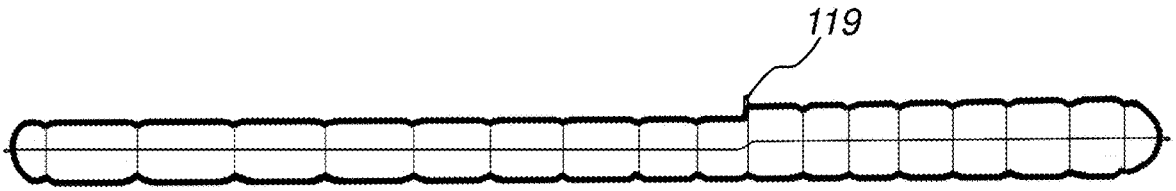
FIG. 7 is a side view of the camping pad of FIG. 6 without a cushion portion.
Figure 8:
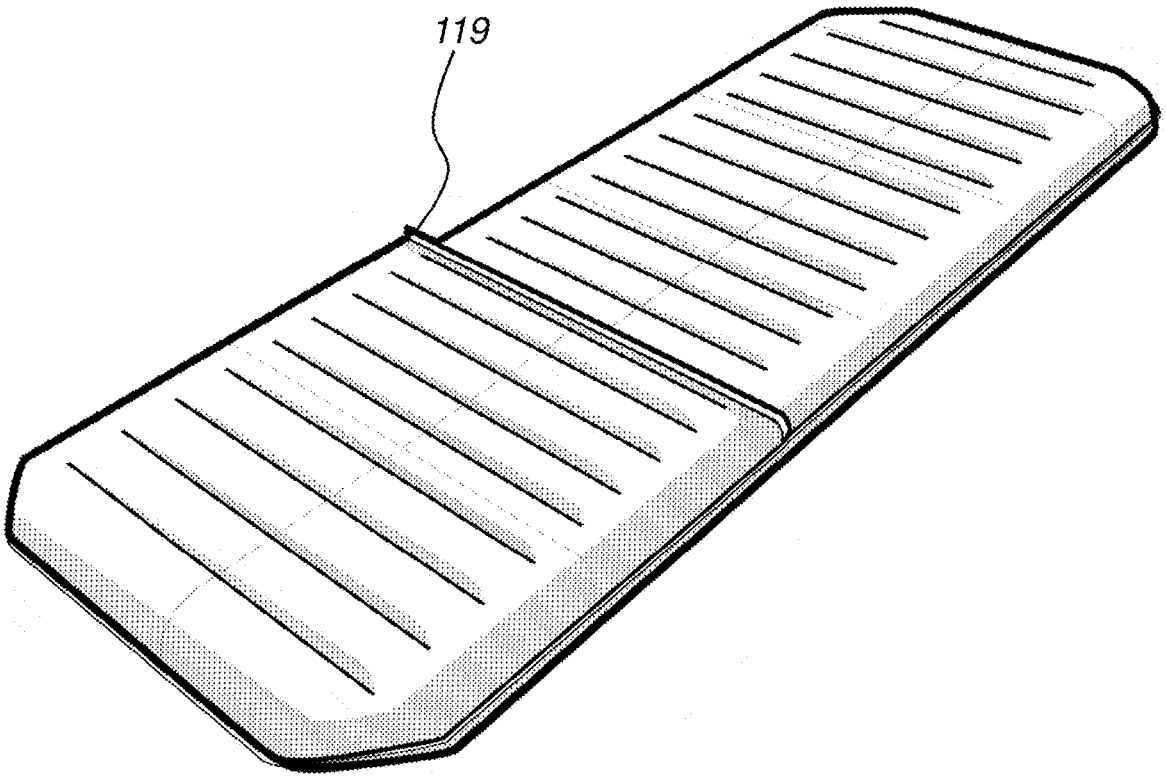
FIG. 8 is a perspective view of the camping pad of FIG. 7 without a cushion portion.

FIG. 6 shows a cross-sectional view of the camping pad 100. A cushion fabric sleeve 122 may be an outer cover for the cushion portion 114, and may be attached directly to the inflatable frame 102 on one or more sides. For example, in some configurations the cushion fabric sleeve may be attached to the inflatable frame 102 on four sides, on the first side 108, the appendage 119, the second side 109, and the first end 104. The cushion portion 114 may comprise a strip of perforated foam. The inflatable top portion 117 of the inflatable frame 102 may include the first sheet of material 124, which may be joined to the second sheet of material 126 at the bond line 103. The bottom portion 111 of the inflatable frame 102, which may include the second sheet of material 126 which may be joined to the first sheet of material 124 at the bond line 103. As seen in FIG. 6, the top fabric sleeve 122 may be fixed around the cushion portion 114; the cushion portion 114 and the top fabric sleeve 122 may be coupled to the first sheet of material 124 of the inflatable top portion 117; and the first sheet of material 124 may be joined to the second sheet of material 126 of the bottom portion 111 at the bond line 103 to form the inflatable frame 102.

Figure 9:
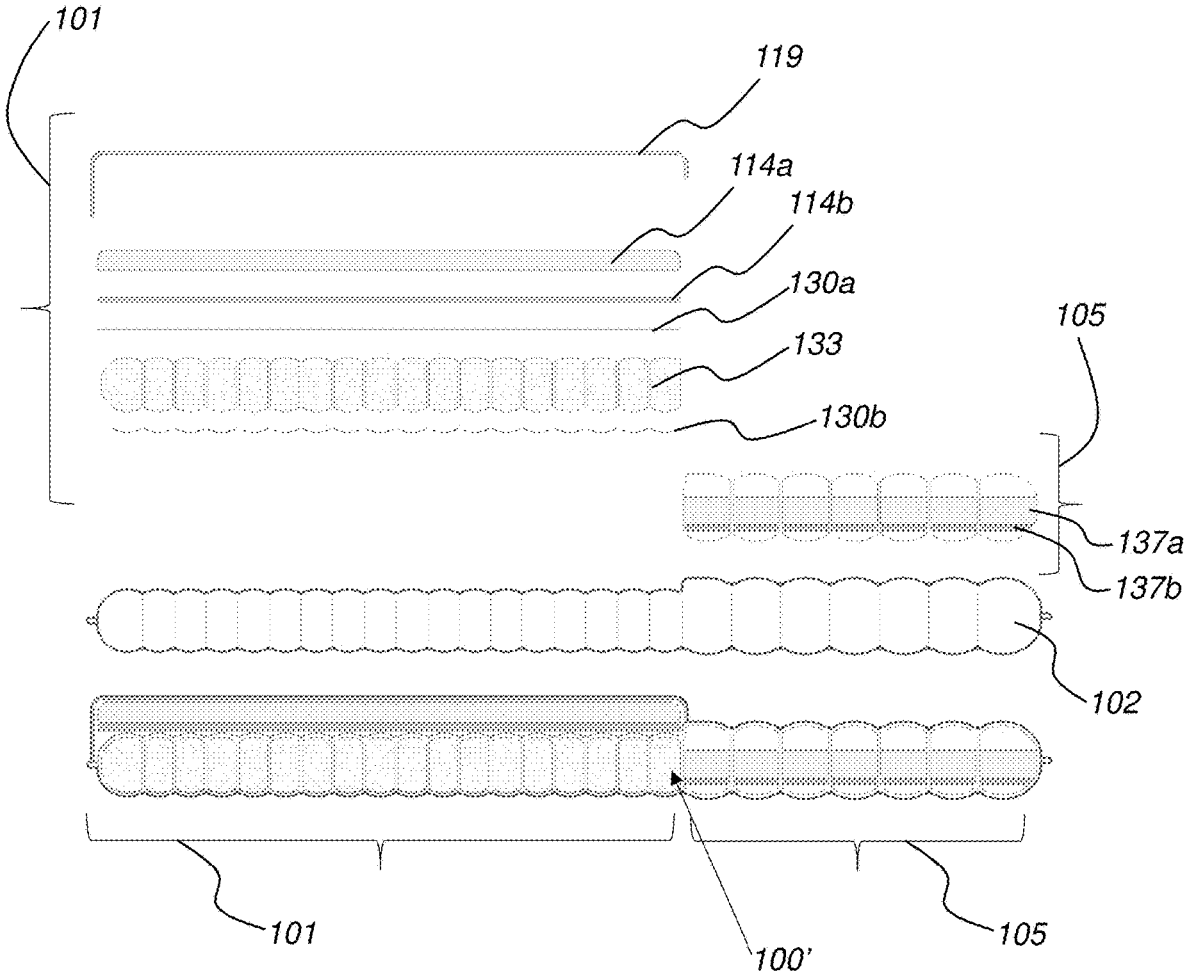
FIG. 9 is an exploded side view of another configuration of a camping pad.

Various additional layers may be included in the camping pad 100 to provide insulation as may be desired. Similarly, various materials may be used to form the layers depending on the purpose of use for the camping pad. In some configurations, the inflatable portion may include insulation and/or foam. Mylar may be included in one or more layers or as a fabric layer. The fabric sleeve 122 may be formed of any suitable material, and if desired may be formed from a material with a soft hand-feel such as a micro fleece fabric, etc. In the alternate camping pad 100' configuration shown in FIG. 9, several layers of insulation and foam may be provided for comfort and/or insulation. For example, the fabric sleeve 122 may be formed of micro fleece. The cushioning portion may include one or more layers of foam, such as a layer of 30 mm PU foam 114*a*, and a layer of ¼" EVA foam 114*b*. Different types of foam having varying densities and varying thicknesses may also be used. One or more layers of PET mylar 130*a*, 130*b* may also be included. Similarly, insulation 133 may be provided within the air frame 102 if desired. In some configurations, one or more layers of foam 137*a*, 137*b* may be provided within the air frame 102 as desired.

Figure 10:
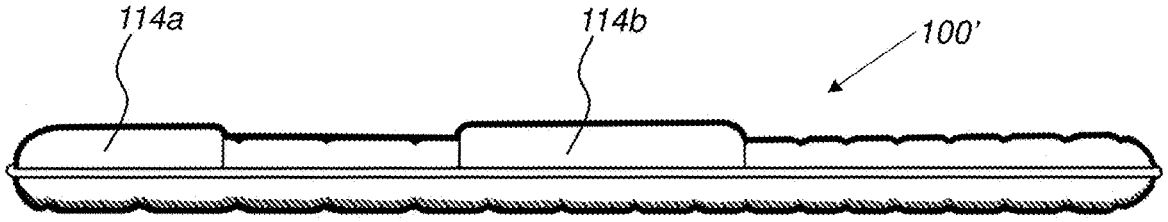
FIG. 10 is a longitudinal side view of another configuration of a camping pad with two separate cushion portions.
Figure 11:
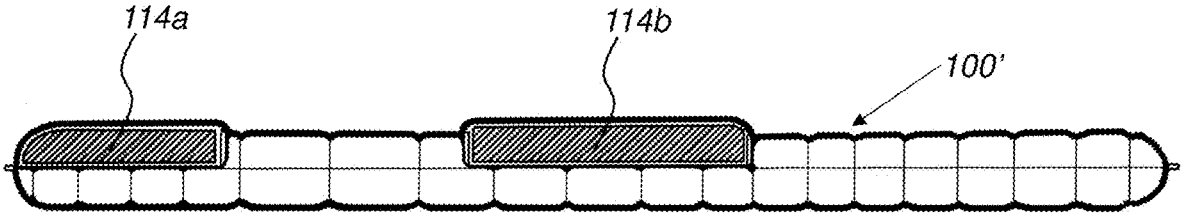
FIG. 11 is a cross-sectional longitudinal side view of the camping pad of FIG. 10.
Figure 12:
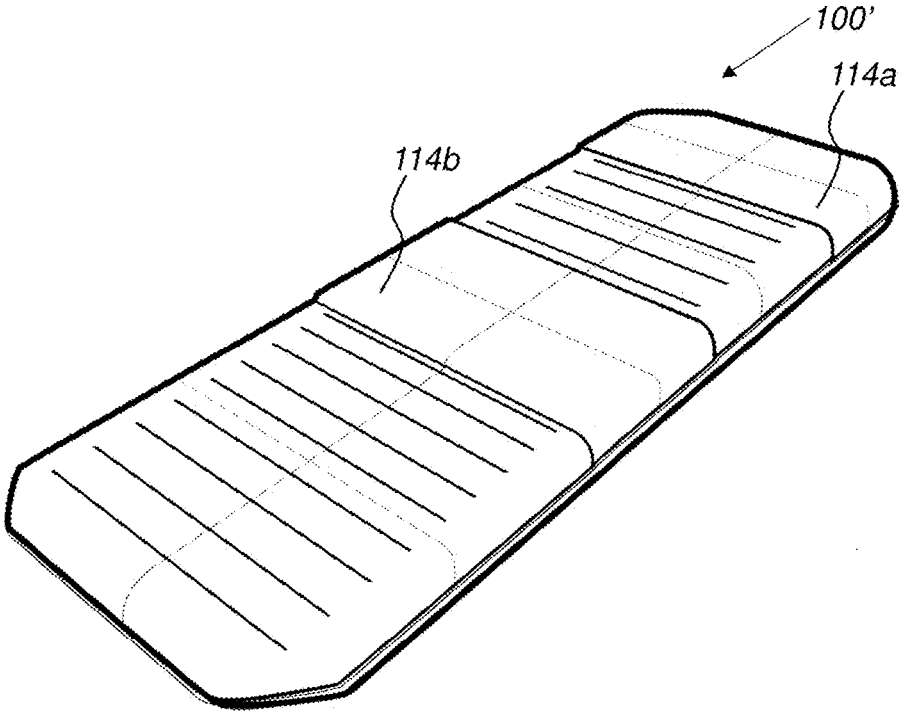
FIG. 12 is a perspective view of the camping pad of FIG. 10.

FIGS. 10-12 show another configuration of a camping pad 100" that may be provided with a first cushion portion 114*a* and a second cushion portion 114*b*. One, two, or more cushion portions may be provided on the camping pad as desired to support a user. For example, in the configurations shown in FIGS. 10-12, the cushioning portions may be provided proximal to the shoulders of a user and proximal to the hips of a user.

An individual may use the camping pad 100 in conjunction with various camping activities. For example, the individual may inflate the inflatable frame 102 of the camping pad 100 by engaging either of the first valve 120*a* (by blowing into the first valve 120*a* with his or her mouth) or the second valve 120*b* (by connecting a pump to the second valve 120*b*). The individual may then place the camping pad 100 beneath the individual's sleeping bag or other sleeping gear and lay on the camping pad 100 for leisure or sleep. Utilizing the camping pad 100 in this manner may provide numerous benefits, including but not limited to, elevating the individual off the ground for insulation purposes and providing the individual with additional comfort while sitting or lying upon the camping pad 100 when the individual is engaged in activities such as camping trips.

When the individual is finished using the camping pad 100, the individual may then deflate the inflatable frame 102 of the camping pad 100 by opening up either of the first valve 120*a* or the second valve 120*b* to let the air escape. The individual may desire to introduce pressure to the camping pad 100 in order to drive the air out of the inflatable frame 102. Once the air is driven from within the inflatable frame 102, the individual may desire to store the camping pad 100 by folding it up, rolling it up, or otherwise compressing it into a more portable shape and size.

Although the foregoing description contains many specifics, these should not be construed as limiting the scopes of the inventions recited by any of the appended claims, but merely as providing information pertinent to some specific embodiments that may fall within the scopes of the appended claims. Features from different embodiments may be employed in combination. In addition, other embodiments may also lie within the scopes of the appended claims. All additions to, deletions from and modifications of the disclosed subject matter that fall within the scopes of the claims are to be embraced by the claims.

What is claimed:

1. A padded sleeping system comprising:

an inflatable frame comprising a first sheet of material joined to a second sheet of material at a plurality of bond lines to form an air inflatable support member, the first sheet of material forming a top side of the inflatable frame and the second sheet of material forming a bottom side of the inflatable frame, the first sheet of material forming an appendage extending across the top side and from a first side of the first sheet of material to a second side of the first sheet of material opposite the first side, the appendage for non-removably connecting a cushion fabric sleeve;

at least one valve coupled to the inflatable frame and being in fluid connection with the air inflatable support member for inflation and deflation thereof;

a sleeping surface formed on the top side of the inflatable frame, the sleeping surface having a cushion portion and a non-cushioned portion, the cushion portion fixed to a portion of the first sheet of material of the inflatable frame;

the cushion portion including the cushion fabric sleeve with a cushioning material therein for supporting a user, the cushion fabric sleeve non-removably fixed to the inflatable frame on a first side, a second side, a first end, and to the appendage of the first sheet of material of the inflatable frame, the appendage allowing the cushioned fabric sleeve to be directly coupled to the first sheet of material from the first side of the first sheet of material to the second side of the first sheet of material; and wherein the cushion fabric sleeve is fixed on a left side to a left side of the first sheet of material, is fixed on a first end to a first end of the first sheet of material, is fixed on a right side to a right side of the first sheet of material, and is fixed on a bottom side to the appendage of the first sheet of material, and wherein the appendage is formed by a pleat of the first sheet of material, the pleat of the first sheet of material being a fold in the first sheet that is folded onto itself.

2. The padded sleeping system of claim 1, wherein the air inflatable support member comprises a plurality of fluidly connected air inflatable support members defined by additional bond lines between the first sheet of material and the second sheet of material.

3. The padded sleeping system of claim 2, wherein the air inflatable support members form linear cells that vary in size and shape based on their position relative to the cushion portion of the padded sleeping system.

4. The padded sleeping system of claim 2, wherein each of the air inflatable support members form a cell or baffle that varies in size and shape corresponding to portions of a user's body for each cell to support.

5. The padded sleeping system of claim 1, wherein the cushion portion comprises a sheet of perforated open cell polyurethane foam having a width that conforms to a width of the inflatable frame and a length that is shorter than a length of the inflatable frame;

wherein the cushion portion is fixed to the inflatable frame.

6. The padded sleeping system of claim 1, wherein the cushion portion comprises a plurality of cushion portions that vary in size and shape and are fixed to the inflatable frame at different positions.

7. The padded sleeping system of claim 1, wherein the cushion portion comprises a plurality of individual cells filled with a synthetic fiber.

8. The padded sleeping system of claim 1, wherein the cushion portion comprises a first cushion portion and a second cushion portion.

9. The padded sleeping system of claim 1, wherein an inside surface of the bottom side of the cushion fabric sleeve is connected to the appendage.

10. A hybrid pad comprising:

an inflatable frame comprising a first sheet of material joined to a second sheet of material along a perimeter at a bond line comprising:

a length and a width that define a pad area for supporting a user lying thereon, the length extending between a superior end and an inferior end and the width extending between a first side and second side; and a plurality of additional bond lines between the first sheet of material and the second sheet of material that form a plurality of fluidly coupled cells, the fluidly coupled cells being inflatable; and at least one valve coupled to the inflatable frame being in fluid connection with the fluidly coupled cells for inflation and deflation thereof; and a sleeping surface formed on a top side of the inflatable frame, the sleeping surface having a cushion portion and a non-cushioned portion, the cushion portion non-removably fixed to the top side of the inflatable frame such that the cushion portion forms a separate, but connected layer of the hybrid pad, the cushion portion non-removably fixed to an appendage of the first sheet of material, the appendage being a pleat of the first sheet of material, the cushion portion extending from the superior end of the inflatable from to the appendage and from the first side to the second side of the inflatable frame, and the non-cushioned portion extending from the appendage to the inferior end and from the first side to the second side of the inflatable frame.

11. The hybrid pad of claim 10, wherein the cushion portion comprises a portion of perforated open cell polyurethane foam comprising:

a width that is approximately equal to the width of the inflatable frame;

a length that is lesser than the length of the inflatable frame;

wherein the portion of foam is fixed to the inflatable frame such that it traverses the width of the inflatable frame and traverses a portion of the length of the inflatable frame beginning at the superior end and extending toward the inferior end.

12. The hybrid pad of claim 10, wherein the plurality of fluidly coupled cells form linear cells or baffles that are substantially parallel to one another, the fluidly coupled cells covered by the cushion portion being narrower in width and smaller in size relative to the fluidly coupled cells that are not covered by the cushion portion.

13. The hybrid pad of claim 10, wherein the portion of foam is within a cushion fabric sleeve attached to the inflatable frame, and wherein the appendage is to secure the cushion fabric sleeve to the inflatable frame.

14. The hybrid pad of claim 13, wherein the portion of foam is within a cushion fabric sleeve attached to the inflatable frame along the length of the perimeter of the superior end, a portion of the perimeter of the first side, a portion of the perimeter of the second side, and along the length of the appendage extending from the first side to the second side.

15. The hybrid pad of claim 10, wherein the first sheet of material comprises an appendage fixed to the top side of the first sheet of material, and wherein the portion of foam is within a cushion fabric sleeve attached to the inflatable frame along the perimeter of the superior end and along at least a portion of the length of the appendage extending from the first side to the second side.

16. A method of using a padded sleeping system comprising:

inflating a sleeping pad, the sleeping pad comprising:

an inflatable frame comprising a first sheet of material joined to a second sheet of material along a perimeter and at a bond line comprising:

a length and a width that define a pad area, the length extending between a superior end and an inferior end and the width extending between a first side and a second side, and an appendage formed as a pleat of the first sheet of material and extending between the first side and the second side across a top side of the first sheet of material; and a valve coupled to the inflatable frame, the valve being in fluid connection with the inflatable frame and for inflation and deflation thereof; and a cushion portion non-removably fixed to a portion of the inflatable frame and not in fluid connection with the inflatable frame;

laying the sleeping pad on an approximately level surface with the cushion portion facing up; and laying upon the sleeping pad.

17. The method of claim 16, wherein the valve is configured to allow a user to inflate the inflatable frame; and wherein inflating the inflatable frame comprises the user blowing air through the valve into the inflatable frame.

18. The method of claim 16, wherein the valve is configured to allow a user to inflate the inflatable frame by attaching a pump thereto; and wherein the user attaches a pump thereto and engages the pump to drive air through the valve into the inflatable frame.

19. The method of claim 16, wherein the cushion portion is within a cushion fabric sleeve attached to the inflatable frame along the length of the perimeter of the superior end, a portion of the perimeter of the first side, a portion of the perimeter of the second side, and along the length of the appendage extending from the first side to the second side.

20. A hybrid pad comprising:

an inflatable frame comprising a first sheet of material joined to a second sheet of material along a perimeter at a bond line, the inflatable frame comprising:

a length and a width that define a pad area for supporting a user lying thereon, the length extending between a superior end and an inferior end and the width extending between a first side and second side; and at least one valve coupled to the inflatable frame for inflation and deflation thereof; and a non-removable cushion portion fixed to a top side of the inflatable frame such that the non-removable cushion portion forms a separate, but connected layer of the hybrid pad, the non- removable cushion portion coupled to the top side of the inflatable frame through an appendage, the appendage being a pleat of the first sheet of material formed along the width extending between the first side and the second side.

* * * * *